US005116303A

United States Patent [19]

Dietrich et al.

[11] Patent Number: 5,116,303

[45] Date of Patent: May 26, 1992

[54] MAGAZINE FOR FLAT ARTICLES, SUCH AS FOLDING BOXES LYING FLAT

[75] Inventors: Walter Dietrich; Eberhard Krieger, both of Weinstadt; Siegfried Weber, Rudersberg, all of Fed. Rep. of Germany

[73] Assignee: Robert Bosch GmbH, Stuttgart, Fed. Rep. of Germany

[21] Appl. No.: 622,579

[22] Filed: Dec. 5, 1990

[30] Foreign Application Priority Data

Feb. 3, 1990 [DE] Fed. Rep. of Germany ..... 4003153

[51] Int. Cl.[5] ..... B31B 1/80

[52] U.S. Cl. ..... 493/313; 271/150; 271/165; 271/213; 493/316

[58] Field of Search ..... 493/313, 314, 315, 316, 493/317, 318, 319; 271/147, 149, 150, 151, 152, 153, 157, 165, 207, 213, 216

[56] References Cited

U.S. PATENT DOCUMENTS

| | | | |
|---|---|---|---|
| 3,580,143 | 5/1971 | McIntyre | 493/313 |
| 3,814,000 | 6/1974 | Heisler | 493/316 |
| 3,858,490 | 1/1975 | Heisler | 493/316 |
| 4,364,549 | 12/1982 | Komossa et al. | 271/165 X |
| 4,385,757 | 5/1983 | Müller | 271/216 X |
| 4,518,301 | 5/1985 | Greenwell | 414/129 |
| 4,596,545 | 6/1986 | Greenwell | 493/315 |
| 4,666,143 | 5/1987 | Reist | 271/216 X |
| 4,667,953 | 5/1987 | Hirakawa et al. | 271/216 X |
| 4,779,860 | 10/1988 | Scarpa | 271/150 X |
| 4,981,292 | 1/1991 | Cosgrove | 271/150 |

FOREIGN PATENT DOCUMENTS

| | | | |
|---|---|---|---|
| 0100143 | 2/1984 | European Pat. Off. . | |
| 0223634 | 12/1984 | Japan | 271/150 |
| 2047663 | 12/1980 | United Kingdom | 271/149 |

*Primary Examiner*—William E. Terrell
*Assistant Examiner*—John A. Marlott
*Attorney, Agent, or Firm*—Edwin E. Greigg; Ronald E. Greigg

[57] ABSTRACT

A magazine for flat articles, in particular folding boxes lying flat, including a horizontal conveyor apparatus for receiving a supply stack of folded boxes and a vertical receiving chute from which the folding boxes can be withdrawn in succession and delivered to a conveyor in an open condition. In order to keep the pressure on the lowermost folding boxes in the receiving chute constant, the receiving chute is refilled with folding boxes as needed from the conveyor apparatus, so that the stack height in the receiving chute remains constant. The transfer of folding boxes from the supply stack on the conveyor apparatus into the receiving chute is effected via a gap, through which the horizontally delivered holding boxes, resting obliquely, are purposefully tipped via rollers or via a support podium into the receiving chute at the transition from the conveyor apparatus.

5 Claims, 2 Drawing Sheets

MAGAZINE FOR FLAT ARTICLES, SUCH AS FOLDING BOXES LYING FLAT

BACKGROUND OF THE INVENTION

The invention is based on a magazine for receiving flat articles, in particular folding boxes lying flat, in stacked form and delivering them individually, as set forth hereinafter.

In a magazine of this type known for instance from European Patent Document A 100 143, (U.S. Pat. Nos. 4,518,301 and 4,596,545) parallel guide rails adjoin a horizontal conveyor apparatus and define an inclined box receiving chute, in which the introduced folding boxes are disposed at a relatively steep angle. In the receiving chute, the folding boxes stand with their lower edges on the lower rails and are supported by their upper edges on the upper rails. Upon entering the receiving chute, the folding boxes, which are supplied on the conveyor apparatus at a relatively flat inclination, are set up at a steep angle by the inclination of the guide rails. A disadvantage here is that the upper edge regions of the folding boxes are pressed hard against one another when they are moved into the steep position, so that the forwardmost folding box in the receiving chute is subject to a relatively high compression. This compression is not constant, however, but instead depends on the supply of folding boxes on the conveyor apparatus at a given time.

OBJECT AND SUMMARY OF THE INVENTION

A magazine according to the invention, as defined hereinafter, has an advantage that since the stack height in the receiving chute is constant, constant conditions allow for continuous withdrawal of folding boxes, and that the magazine can be refilled with folding boxes by a worker at an easily reached working height. The relatively slight tilting of the forwardmost folding box from the conveyor apparatus into the receiving chute also provides high operational reliability.

Further features of the magazine defined herein enable a particularly simple, friction-free transfer of folding boxes from a region of the conveyor apparatus into the receiving chute.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
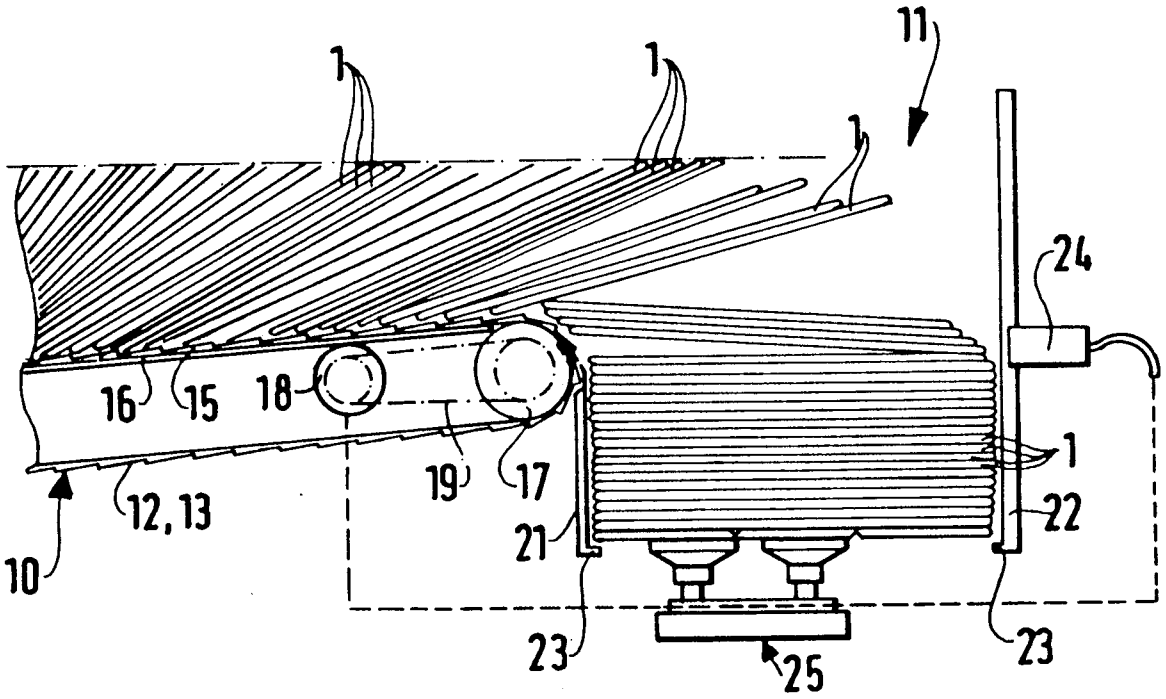
FIG. 1 shows a side view of a first exemplary embodiment of a folding box magazine in simplified form.

The magazine for receiving a supply of folding boxes 1 and delivering one folding box at a time has a conveyor apparatus 10 and a receiving chute 11. By way of example, the conveyor apparatus 10 has two endless conveyor belts 12, 13 extending parallel, the upper runs 15 of which rest on a table 16. The table 16 and the upper runs 15 extend substantially in a horizontal plane, preferably rising slightly toward the delivery end of the conveyor belts 12, 13. On the delivery end, the conveyor belts 12, 13 are guided around deflection rollers 17, which are driven by a motor 18 via a chain drive 19. The conveyor belts 12, 13, embodied as toothed belts, have sawtooth-like teeth 14 on their outside the points of which point in the conveying direction.

The delivery end of the conveyor belts 12, 13 is adjoined by the receiving chute 11 extending downward at major inclination, preferably vertically. It is embodied substantially of vertical guide walls or rails 21, 22 one of which is higher than the other, which have retaining lugs 23 protruding from their bottom ends, which are located in the same plane. A feeler 24 which is adjustable in height is disposed laterally of the receiving chute 11 and ascertains the absence or the lowering of the level of folding boxes 1 in the receiving chute 11 and triggers the electric motor 18 for the conveyor apparatus 10 in order to fill the chute with folding boxes. A movable suction head 25 is associated with the lower, open end of the receiving chute 11 and pulls the lowermost folding box resting on the retaining lugs 23, one at a time, out of the receiving chute 11 and transfers it to a conveyor apparatus (not shown) of a packaging machine.

The folding boxes 1 to be processed are placed in stacks on the table 16, or on the upper runs 15 extending along it of the conveyor belts 12, 13, by a worker, who puts them in an oblique position in which the folding boxes 1 are inclined with their upper edges in the conveying direction of the conveyor belts 12, 13, at an angle in the range from 30° to 60°. The result, at the transition from the conveyor apparatus 10 into the receiving chute 11, is that the stack of folding boxes is separated, forming a wedge-shaped gap between the stack of folding boxes 1 resting on the conveyor belts 12, 13 and the stack of folding boxes 1 located in the receiving chute 11; at the transition from the conveyor apparatus 10 into the receiving chute 11, the forwardmost folding boxes 1 of the stack resting on the conveyor belts 12, 13 and table 16 protrude by their upper, leading edges into the receiving chute 11. In the region of the transition from the conveyor apparatus 10 into the receiving chute 11, the folding boxes 1 tip successively out of their oblique position downward into a horizontal position onto the upper end of the stack of folding boxes formed in the receiving chute 11. The height of the stack of folding boxes in the receiving chute 11 is monitored by the feeler 24, which switches on the motor 18 of the conveyor apparatus 10 whenever the stack drops, so that the conveyor belts 12, 13 push the stack of folding boxes on toward the direction of the receiving chute 11.

Figure 2:
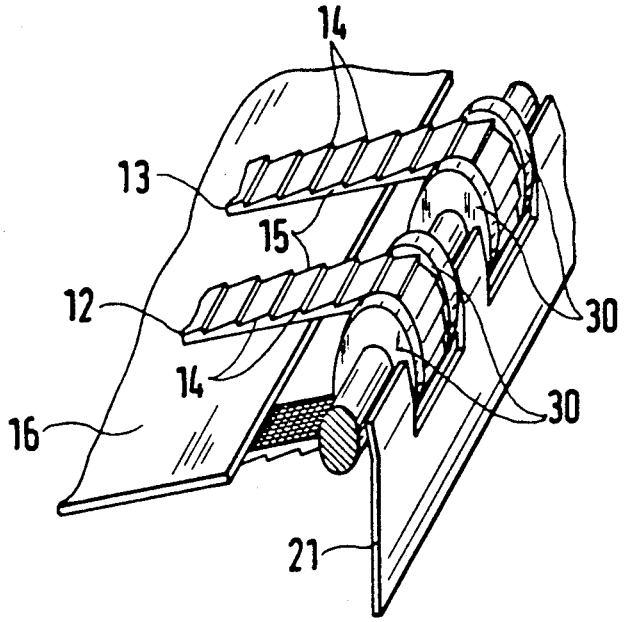
FIG. 2 is a perspective view of the transition from a conveyor apparatus to a delivery chute for the magazine of FIG. 1.

In the exemplary embodiment of FIGS. 1 and 2, a plurality of rollers 30 are disposed on the delivery end of the conveyor apparatus 10, coaxially with the axis of the deflection rollers 17 for the conveyor belts 12, 13; the rollers 30 are firmly connected to the deflection rollers 17, and their radius is greater than that of the deflection rollers 17, preferably being equal to the sum of the radius of the deflecting rollers 17 and the maximum thickness of the conveyor belts 12, 13, so that in the deflection region of the conveyor belts 12, 13 the folding boxes 1, resting on the circumference of the rollers 30, become disengaged from the teeth 14 of the conveyor belts 12, 13. As a result, the form-fitting thrust exerted by the conveyor belts 12, 13 is relieved, so that the forwardmost folding boxes 1 of the horizontal stack, which now tip into the receiving chute 11, are pushed completely into the receiving chute 11 from the rollers 3 only by the following folding boxes 1. The trailing edge regions of these boxes support the following folding boxes 1, which are held in the oblique position by the weight and pressure of the folding boxes 1 following them, so that the forwardmost folding boxes 1 of the horizontal stack form the abovedescribed gap. With this support of the following folding boxes 1 in the horizontal stack, the pressure exerted, or the weight, is not transmitted to the folding boxes 1 in the receiving chute 11 but is instead absorbed by the rollers 30, so that only the weight of the folding boxes 1 located in the receiving chute 11 is definitive for the pressure at the retaining lugs 23.

Figure 3:
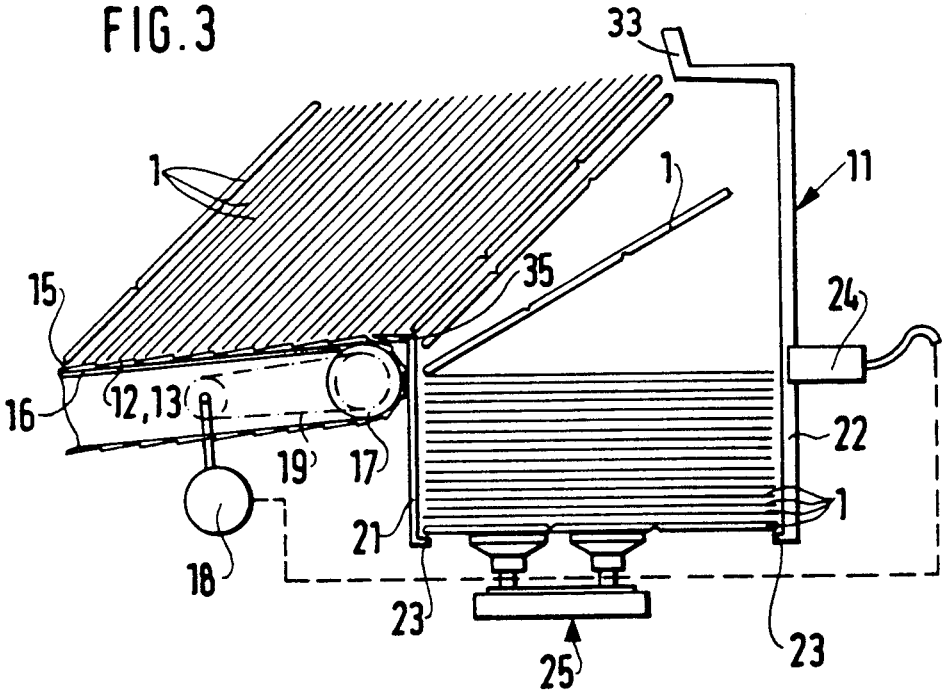
FIG. 3 shows a side view of a second exemplary embodiment of a folding box magazine, again in a side view.

In the exemplary embodiment of FIG. 3, the wedge-shaped gap between the folding boxes 1 located on the conveyor belts 12, 13 and those in the receiving chute 11 is formed by a stop 33, against which the upper edge of the forwardmost folding boxes 1 of the stack resting on the conveyor belts 12, 13 abuts and is intermittently supported. The stop 33 is disposed at the level of the uppermost edge of the folding boxes 1, which are in an oblique position at an angle of 30° to 60°, and is disposed far enough away from the delivery end of the conveyor apparatus 10 that the connecting line between this end and the stop 33 forms an angle of 30° to 60°. In the region of the deflection rollers 17 of the conveyor belts 12, 13, a narrow support podium 35 adjoins the extension of the conveying plane of the upper runs 15 of the conveyor belts 12, 13; its free end coincides with the associated guide rail 21 of the receiving chute 11. When the stack of folding boxes resting on the conveyor belts 12, 13 is advanced, the folding boxes 1 that are forwardmost in the conveying direction are raised by the support podium 35 out of the gaps between the teeth 14 of the conveyor belts 12, 13; the forwardmost folding box rests with its upper edge on the stop 33. As the following folding boxes 1 are pushed onward, the forwardmost one is pushed over the support podium 35, where at its front edge the folding boxes 1 drop successively by their lower edge into the receiving chute 11, guided by the guide rail 21. Their upper edge also slips off the stop 33 at this time, so that they tilt through the wedge-shaped gap into the receiving chute 11 onto the stack of folding boxes 1 located there and assume a horizontal position in the chute.

It should additionally be noted that the delivery of the folding boxes by the conveyor apparatus 10 into the receiving chute 11 is not necessarily associated with tilting of the folding boxes along a particular edge; the folding boxes can instead be tilted from the conveyor apparatus into the receiving chute along any of their circumferential edges, although the association between the conveying apparatus and the receiving chute must be made such that the folding boxes do come to rest in the receiving chute in the prescribed position. It should also be noted that the dimensions of the receiving chute are adaptable for handling various formats of folding boxes, and that the stop 33 is also adjustable for the upper edge of the folding boxes.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A magazine for receiving flat articles, in the form of folded boxes lying flat, in stacked form for delivering them individually, into a delivery conveyor in opened form, having a conveyor apparatus extending substantially in a horizontal plane rising slightly toward a delivery end of said conveyor apparatus on which the folded boxes are stacked in an oblique position and covering one another, the folded boxes are moved with their upper edge region in a forward position from a rear portion of the conveyor; a receiving chute adjoins a front end of the conveyor apparatus for receiving folded boxes; a feeler device is positioned relative to said receiving chute for monitoring the filling of the receiving chute, said feeler device triggers movement of the conveyor apparatus for refilling the receiving chute if the supply of folded boxes in the receiving chute drops below said feeler device, said receiving chute (11) substantially adjoins the conveyor apparatus (10) in a vertical alignment with the folded boxes (1) resting horizontally one above the other in the receiving chute; a wedge-shaped gap is formed between the folded boxes (1) stacked in an oblique position on the conveyor apparatus (10) and those stacked horizontally in the receiving chute (11), wherein the forwardmost folded boxes, in the conveyor direction, disposed on the conveyor apparatus protrude freely by their upper, leading edge region, past the receiving chute portion at the transition from the conveyor apparatus to the receiving chute (11) and are pressed onto the conveyor apparatus by their trailing edge region by the weight of the following folded boxes, said leading boxes tilt progressively out of the oblique position into the horizontal position in the receiving chutes; and the height of the stack of folded boxes in the receiving chute (11) is maintained constant by triggering of the conveyor apparatus (10) by said feeler device (24) associated with the receiving chute.

2. A magazine as defined by claim 1, in which the conveyor apparatus (10) has at least one endless toothed belt (12, 13) having a substantially upper horizontal run (15) and a deflection portion adjacent the receiving chute (11).

3. A magazine as defined by claim 2, the deflection portion including rollers (3) disposed on a deflection path, said rollers are coaxial with an axis of the deflection path and a radius of said rollers extends to the deflection path alongside said at least one conveyor belt.

4. A magazine as defined by claim 3, in which the rollers (30) are rotationally driven in the conveying direction.

5. A magazine as defined by claim 1, which includes a stationary stop (33) disposed above the vertical receiving chute (11), against which stop the forwardmost folding box (1) in the conveying direction rests with its upper, leading edge region, and a support (35) disposed at a transition between the conveyor apparatus (10) and the receiving chute (11) along which the forwardmost, obliquely positioned folding box slips and tilts into the receiving chute.

* * * * *